United States Patent [19]

Dougherty, Sr.

[11] 4,416,400

[45] Nov. 22, 1983

[54] ONE PIECE DISPENSER

[75] Inventor: Frank E. Dougherty, Sr., Mays Landing, N.J.

[73] Assignee: Dougherty Brothers Company, Buena, N.J.

[21] Appl. No.: 954,253

[22] Filed: Oct. 24, 1978

[51] Int. Cl.[3] ..... B65D 47/18

[52] U.S. Cl. ..... 222/420; 141/24; 604/212

[58] Field of Search ..... 222/420; 141/21-25; 128/231, 233; 604/212, 310, 403

[56] References Cited

U.S. PATENT DOCUMENTS 2,651,437 9/1953 Fields ..... 141/24
2,742,195 4/1956 Elder, Jr. ..... 141/24
2,872,950 2/1959 Castelli ..... 141/24

FOREIGN PATENT DOCUMENTS 286273 2/1953 Switzerland ..... 141/24

*Primary Examiner*—Robert B. Reeves
*Assistant Examiner*—Edward M. Wacyra
*Attorney, Agent, or Firm*—Seidel, Gonda & Goldhammer

[57] ABSTRACT

A container cap having threads on a surface thereof is integral in one piece with a flexible bulb having a wall thickness thinner than the wall thickness of the cap. A pipette is coaxial with the cap and bulb and welded to the cap. The cap, bulb and pipette are made from a polymeric plastic.

7 Claims, 4 Drawing Figures

FIG. 1
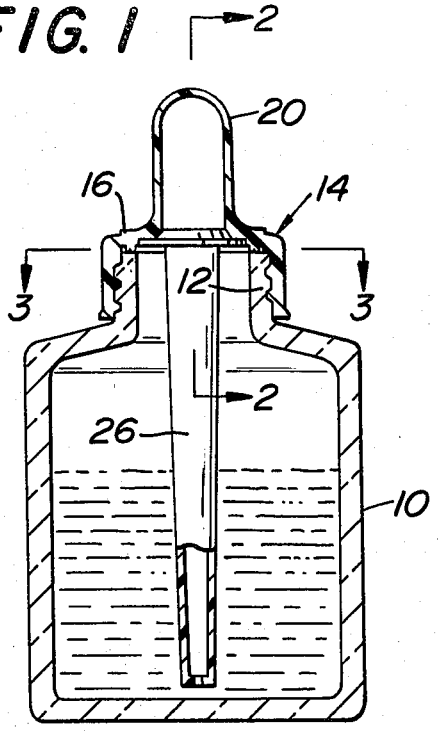
FIG. 2
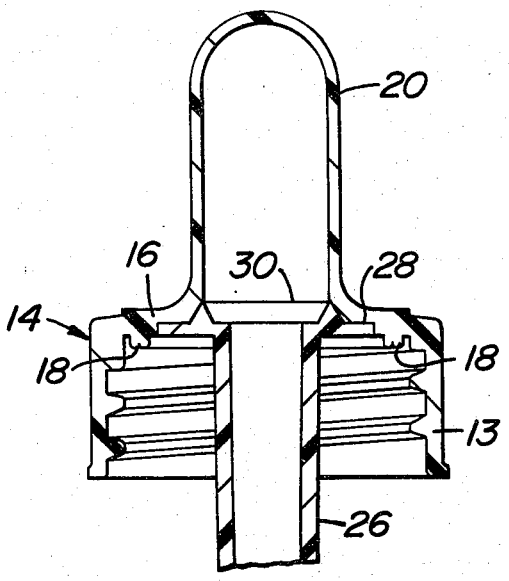
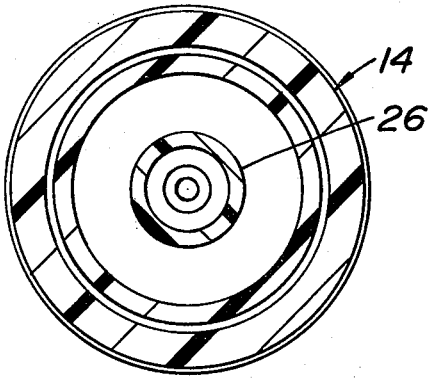
FIG. 3
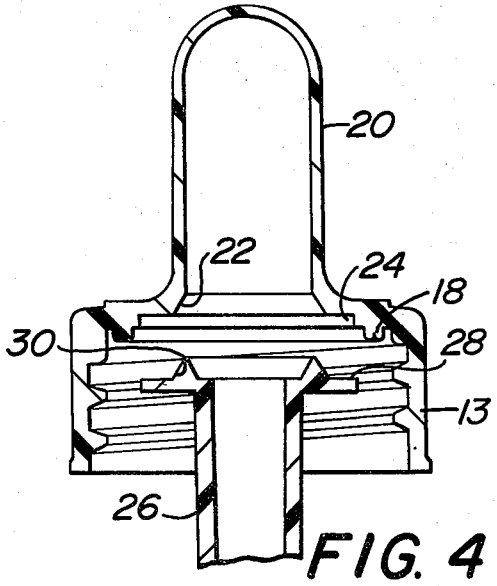
FIG. 4

ONE PIECE DISPENSER

BACKGROUND

It is known to make a dispensing device of the type involved herein in two parts. See U.S. Pat. No. 2,872,950 wherein a pipette has a thick flange so that it may be snap-fitted into a cap which is integral with a bulb.

A two piece dispensing device as disclosed in said patent has numerous disadvantages. Due to the substantial thickness of the flange at the upper end of the pipette, more plastic material is used than is necessary. The pipette can become separated from the cap at times which are most inconvenient such as when a mother is feeding a baby and the baby bites down on the pipette while the mother is pulling on the cap in an effort to remove the pipette from the baby's mouth. The two piece construction as disclosed in said patent requires a different sized pipette for each different size of cap. The above disadvantages are overcome by the present invention.

SUMMARY OF THE INVENTION

The dispensing device of the present invention includes a circular cap having threads on a surface thereabove to facilitate removably coupling the cap to a container. A flexible bulb is integral in one piece at an open end thereof with said cap. The bulb has a wall thickness which is substantially less than the wall thickness of the cap so as to be more flexible.

A pipette is coaxial with the cap and the bulb. One end of the pipette has a flange welded to a top wall of the cap adjacent the intersection of the cap top wall and the bulb. The top wall of the cap extends radially outwardly from the periphery of the pipette flange. Said end of the pipette is in open communication with the bulb. The other end of the pipette is open. The cap, bulb and pipette are made from a polymeric plastic material.

It is an object of the present invention to provide a one piece dispenser which includes a cap, bulb and pipette wherein the pipette cannot be separated from the cap and wherein one size pipette may be used with a plurality of different sized caps.

It is another object of the present invention to provide a one piece dispenser which is simple, inexpensive, reliable and which uses a minimum of material.

Other objects will appear hereinafter.

For the purpose of illustrating the invention, there is shown in the drawings a form which is presently preferred; it being understood, however, that this invention is not limited to the precise arrangements and instrumentalities shown.

FIG. 1 is a sectional view of a container containing a one piece dispenser in accordance with the present invention.

FIG. 2 is a sectional view of the one piece dispenser on an enlarged scale.

FIG. 3 is a sectional view taken along the line 3—3 in FIG. 1 but on an enlarged scale.

FIG. 4 is an exploded view showing the pipette separate from the cap.

Referring to the drawings in detail, wherein like numerals indicate like elements, there is shown in FIG. 1 a glass container 10 having a threaded neck 12. A cap 14 is secured to the neck 12. The cap 14 includes a circular rim 13 having threads on its inner periphery for mating engagement with threads on the outer periphery of the neck 12.

The cap 14 includes a generally horizontally disposed top wall 16 extending radially inwardly from the rim 13. Wall 16 has a downwardly extending bead 18 radially inwardly from the threads on rim 13. Bead 18 contacts the rim of neck 12 to form a seal. A bulb 20 is integral in one piece at its open end with the wall 16. Bulb 20 has a wall thickness which is substantially thinner than the wall thickness of the cap 14. A suitable wall thickness for the bulb 20 is approximately 0.015 inches.

As shown more clearly in the exploded view of FIG. 4, the cap 14 is provided with a beveled surface 22 adjacent the intersection of bulb 20 and the wall 16. Surface 22 is at an angle of approximately 30° with respect to the axis of the cap. Contiguous with the beveled surface 22, there is provided a circular recess 24 on the bottom surface of wall 16 radially inwardly from the bead 18.

A pipette 26 is open at each end and preferably is tapered as shown in FIG. 1. At the upper end, the pipette 26 has a radially outwardly directed annular flange 28. The annular flange 28 is received within the annular recess 24. Flange 28 has a thickness corresponding to the depth of recess 24. Radially inwardly from its outer periphery, and on its upper surface, flange 28 is provided with an axially directed circular bead 30. The outer periphery of bead 30 is angled so as to mate with the beveled surface 22.

The upper surface of flange 28 and the outer peripheral side face of the bead 30 are welded to the juxtaposed surfaces of the cap 14. The weld is preferably attained using an ultrasonic ring welder which forms a ring shaped weld simultaneously at all parts of the weld. Such ultransonic welding apparatus is well known and can form such a weld in less than 1 second. The bead 30 acts as an energy concentrator during the welding process. Welds of this nature are as strong as the base material. Each of the pipette, cap and bulb are made from a polymeric plastic material. The preferred material is polypropylene but other materials such as polyethylene may be used.

Since the flange 28 on the pipette is radially inwardly from the bead 18, the flange 28 is not a part of the seal between the cap 14 and the container 10. Hence, a single size pipette may be used with various sized caps 14. As illustrated, the diameter of the flange 28 is slightly smaller than the diameter of the recess 24. On a larger sized cap, flange 28 would still be received in recess 24 but would have a diameter substantially smaller than the diameter of the recess 24 at the outer periphery thereof. As a result thereof, the necessity for separate molds for different size pipettes is eliminated. Since the pipette 26 and its flange 28 form no part of the seal between the cap and the container, flange 28 may have a thickness corresponding generally to the wall thickness of pipette 26 whereby less plastic material is utilized.

The present invention may be embodied in other specific forms without departing from the spirit or essential attributes thereof and, accordingly, reference should be made to the appended claims, rather than to the foregoing specification, as indicating the scope of the invention.

I claim:

1. A one piece dispenser comprising a circular cap having threads on a surface thereof to facilitate coupling of the cap to a container, a flexible bulb integral in one piece at the open end thereof with a top wall of said cap, said bulb having a wall thickness of substantially less than the wall thickness of said top wall of said cap so as to be more flexible, a pipette coaxial with said cap and bulb, one end of said pipette having a flange welded to said top wall of said cap at a location radially inwardly of the periphery of said flange and adjacent the intersection of said top wall and said open end of said bulb, the inner surface of said top wall of said cap having an annular recess within which is disposed said pipette flange, said top wall of said cap extending radially outwardly from the periphery of said flange, said inner surface of said top wall having a bead radially outwardly from said recess, said bead being adapted to contact the rim of a container when the cap is coupled to a container, said one end of said pipette being in open communication with said bulb, said cap, bulb and pipette being made from a polymeric plastic material.

2. A dispenser in accordance with claim 1 wherein said cap is provided with a beveled surface adjacent the intersection of said bulb and said top wall, said pipette flange having a bead on an upper surface thereof, said bead having an outer peripheral surface which is beveled to mate with said beveled surface on said cap, said beveled surfaces being bonded together by said weld.

3. A dispenser in accordance with claim 1 wherein said pipette flange has a thickness corresponding generally to the thickness of the wall of said pipette.

4. A one piece dispenser comprising a circular cap having threads on an inner surface thereof to facilitate coupling the cap to a container, said cap having a radially inwardly directed top wall, a flexible bulb integral in one piece at the open end with said cap top wall, said bulb having a wall thickness substantially less than the wall thickness of said top wall, a pipette coaxial with said cap and bulb, said pipette having a radially outwardly directed flange at one end thereof, a bead on the upper surface of said flange, the outer peripheral face of said bead on the top surface of said flange being welded to a juxtaposed surface on said cap top wall, the inner surface of said top wall extending radially outwardly from the periphery of said flange and constituting the part of the cap for contact with a rim of a container, said cap, bulb and pipette being made from a polymeric plastic material.

5. A dispenser in accordance with claim 4 wherein said contact part of said cap top wall radially outwardly from said pipette flange includes an axially directed annular bead.

6. A dispenser in accordance with claim 4 wherein said bead on said pipette flange has an outer peripheral surface disposed at an acute angle, said juxtaposed surface of the cap being a beveled surface defining the intersection of said top wall and said bulb, said beveled surface being at substantially the same angle as said bead and being welded to each other.

7. A dispenser in accordance with claim 6 wherein said acute angle is approximately 30° with respect to the axis of the cap.

* * * * *